United States Patent [19]

Rich

[11] 4,337,914

[45] Jul. 6, 1982

[54] RAILWAY SWITCH STAND COVER

[75] Inventor: Brett Rich, Malad City, Id.

[73] Assignee: Oneida General Corp., Malad City, Id.

[21] Appl. No.: 152,627

[22] Filed: May 23, 1980

[51] Int. Cl.[3] ..... B61L 5/02; E01B 7/20; E01B 15/00

[52] U.S. Cl. ..... 246/428; 246/393; 246/415 R; 246/476

[58] Field of Search ..... 246/428, 393, 415 R, 246/428, 476

[56] References Cited

U.S. PATENT DOCUMENTS 1,661,040 2/1928 Gerrasio ..... 246/428
1,758,519 5/1930 Janville ..... 246/428

*Primary Examiner*—Joseph F. Peters, Jr.
*Assistant Examiner*—Howard Beltran
*Attorney, Agent, or Firm*—Mallinckrodt & Mallinckrodt

[57] ABSTRACT

A railroad head block switching installation having a safety cover secured to the track ties between which extend the connecting rod of the rail switching mechanism, so as to overlie such rod in spaced relationship therewith and protect persons from tripping over the rod. The safety cover is preferably of plate formation molded from a weight-supporting structural plastic material to provide opposing ramp sections and a central section in common therewith and spaced above the rod. Longitudinal and transverse reinforcing ribs are advantageously provided on the undersurface of the cover, with lag-bolt-accommodating bosses formed at the intersections of such ribs.

7 Claims, 4 Drawing Figures

RAILWAY SWITCH STAND COVER

BACKGROUND OF THE INVENTION

1. Field

The invention is in the field of railroad switching installations.

2. State of the Art

Railroad yards typically include manually operated head block switching installations to switch rail cars from one track to another. In such an installation, a pair of stationary rails diverge and a pair of switching rails are arranged in conjunction therewith to be moved one way or another to, for example, either maintain an engine or a train on a main track or to switch it to a branch track. The switching rails are shifted by mechanism which includes linkage that extends beneath the track to connections with such switching rails. A head block switching stand, which supports manually operated components of the switching mechanism, is normally provided off to one side of the rails on extended portions of mutually adjacent, unusually elongate, special ties for rail shifting purposes. Its manually-operated mechanism is operably attached to a switching bar portion of the linkage by means of an elongate connecting rod portion of such linkage, which extends between the special ties and constitutes a hazard to persons walking beside the tracks, particularly when such connecting rod rises above tie level as it frequently does. The uncovered rod is often tripped over, and feet are caught in the space between the ties. Switchmen have experienced broken legs and twisted or sprained ankles. Filling the space between the ties with ballast to prevent accidental insertion of a person's feet between rod and ties has been found to unacceptably bind the rod. In fact, accumulations of debris must frequently be removed to avoid such binding. Therefore, this long-recognized hazard to the safety of switchmen and other workers has traditionally been tolerated.

BRIEF SUMMARY OF THE INVENTION

The present invention eliminates or significantly alleviates the foregoing disadvantages in the present art of railroad head block switching installations by providing an elongate safety cover upon and secured to the extended portions of the special ties so as to span the space therebetween and bridge over a major portion of the length of the connecting rod. The cover is of elongate, preferably rectangular, plate construction contoured upwardly transversely of its length as opposing ramps of substantially equal extent and slope leading to a central, preferably level section in common overlying and clearing the connecting rod, while still having a low profile presenting negligible tripping hazard. The widths of the opposing ramp sections and of the central section of such cover extend longitudinally of the cover and, together, provide a transverse overall dimension for the cover equivalent to a distance from outer longitudinal margin to outer longitudinal margin of the two special ties, which are spaced apart in accordance with normal tie spacing. This provides gradually upwardly sloping ramp sections contoured at both sides of the cover to minimize tripping danger. The upper surface of the cover is advantageously formed as a non-slip tread, and the underside is desirably ribbed for rigidity and dimensional stability.

Accordingly, it is a principal object of the invention to provide a safety cover for the switching connecting rod of a railroad head block switching installation that will substantially prevent the usual hazards to workmen and others walking along the railroad tracks and that will provide desirable foot traction and will prevent accumulation of debris about the rod such as would tend to bind operation thereof.

THE DRAWINGS

In the accompanying drawings, which exemplify the best mode presently contemplated of carrying out the invention:

FIG. 1 is a perspective view of a railroad head block switching installation with safety cover according to the invention;

FIG. 2, a transverse vertical section taken on the line 2—2 of FIG. 1 and drawn to a somewhat larger scale;

FIG. 3, a fragmentary view corresponding to the right hand portion of FIG. 2 but taken through a lag screw hole and drawn to a still larger scale; and FIG. 4, a bottom plan view of the safety cover per se.

DETAILED DESCRIPTION OF THE ILLUSTRATED EMBODIMENT

Figure 1:
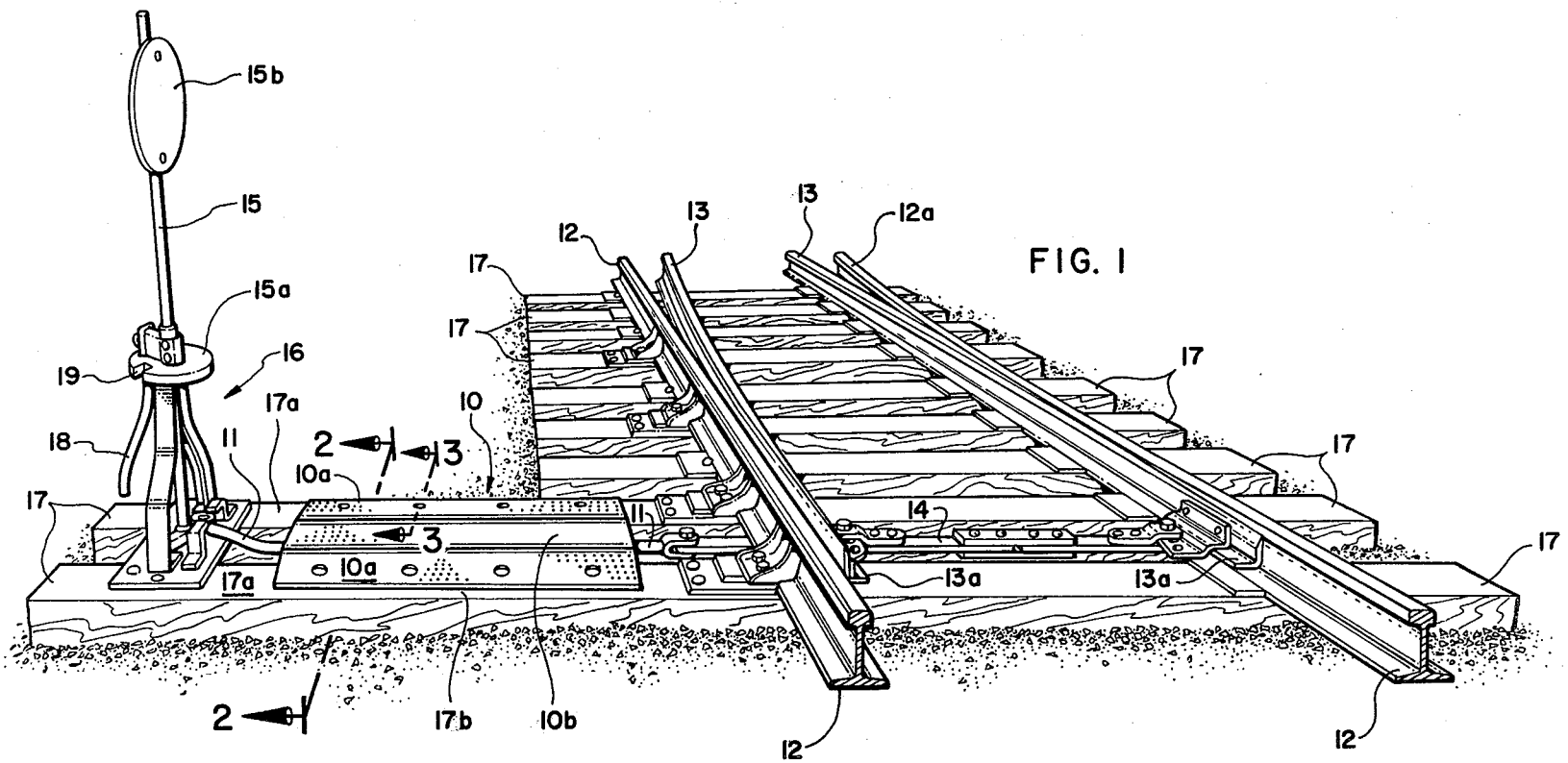

In the form illustrated, a standard railroad head block switching installation has a safety cover 10 secured over a connecting rod 11 of the switching mechanism in accordance with the invention. In the installation, the railroad track comprises a pair of stationary rails 12, and a pair of movable switching rails 13. As customary in such an installation for switching a rail car from a main track to a branch track, one of the stationary rails 12 curves away from the other, as at 12*a*, to provide one rail of the branch track. The switching rails 13 have tapered ends 13*a*, respectively, which are adapted to be moved against and merge into the inner sides of the stationary rails. For switching purposes, one of such switching rails is moved into this merging relationship with its corresponding stationary rail while the other is moved out of such merging relationship with its corresponding stationary rail. Each of the switching rails is pivotally secured to a usual slidable switching bar 14 extending transversely of and below the rails 12 and 13.

Switching rails 13 are shifted by switching bar 14, which is pivotally connected in the usual manner to an end of connecting rod 11. The other end of such connecting rod is also pivotally connected in the usual manner to a manually rotated spindle 15 mounted in a usual switching stand 16.

Rails 12 and 13 are positioned on and secured to the usual railroad ties 17, which are spaced apart in normal manner. As is customary, two mutually adjacent ties are special, being elongated so as to extend outwardly of the others, as at 17*a*, at one side of the track for receiving switching stand 16. Connecting rod 11 and switching bar 14 are positioned between such special ties, the latter extending to and under rails 12 and 13 at about the level of the upper surfaces of the ties and the former being dangerously positioned either at or above that same level and in the path normally taken by a switchman walking beside the track.

For switching purposes, the usual hanging handle 18 is raised by the switchman from engagement with a locking notch 19 in stand 16 and is used to rotate spindle 15, after which it is dropped into the alternate notch 19. A signal disc 15*b* turns with the spindle to indicate visually the shifted position of switching rails 13.

As previously indicated, switchmen frequently trip over connecting rod 11 or entangle their feet and ankles in the spaces along either side thereof and suffer injuries. Such spaces cannot be filled with ballast, since this would bind rod 11. In fact, accumulations of debris must often be removed to prevent such binding. Pursuant to the invention, the safety cover 10 eliminates both problems.

As illustrated, safety cover 10 is of elongate rectangular formation having opposing ramp sections 10*a*, respectively, sloping upwardly transversely of the length of such cover to a substantially level section 10*b*. The ramp sections 10*a* are desirably of equal extent and share level section 10*b* in common. The slope is such that, when the safety cover is in place on special tie extensions 17*a* so as to cover connecting rod 11, level section 10*b* is spaced above such connecting rod. To minimize the angles of upward slope of the ramp sections, the widths of such ramp sections and of the central level section extending longitudinally of the safety cover 10 are such that, together, they provide a transverse overall width dimension for the cover equivalent to a distance from the outer longitudinal margin 17*b* of one of the special ties to the outer longitudinal margin 17*b* of the other of such special ties. The length of safety cover 10 is such as will cover the major portion of connecting rod 11 intermediate its connection end portions and lying within the normal walkway path of a switchman responsible for operating the switching mechanism.

Cover plate 10 is preferably molded to shape from a structural plastic material, such as a polyethylene structural foam, so as to support the weight of persons walking over it as well as of vehicles which sometimes run over it. For this purpose, reinforcing longitudinal and transverse ribs 20 and 21, respectively, are provided on its underside, the former along the longitudinal margins and the latter at intervals transversely of the ramp sections 10*a* and the central section 10*b* and tapering at their ends 20*a* to the level of the ramp undersides at the longitudinal edges of the cover so such edge undersides will seat firmly upon the railroad ties 17. At the intersections of the longitudinal and transverse ribs, respective bosses 22 for accommodating lag screw holes 23 are molded to the level of the tapered ends 21*a* of the transverse ribs and, together with such tapered ends, seat firmly upon the railroad ties 17.

Holes 23 may be provided by molding them into the bosses 20 at the time of molding the safety cover 10 or they may be drilled through the bosses after the cover is molded. In either event, they are countersunk into the upper surface of the cover so as to recess the heads of lag screws 24 used to secure safety cover 10 to the ties 17 upon which it rests.

Figure 2:
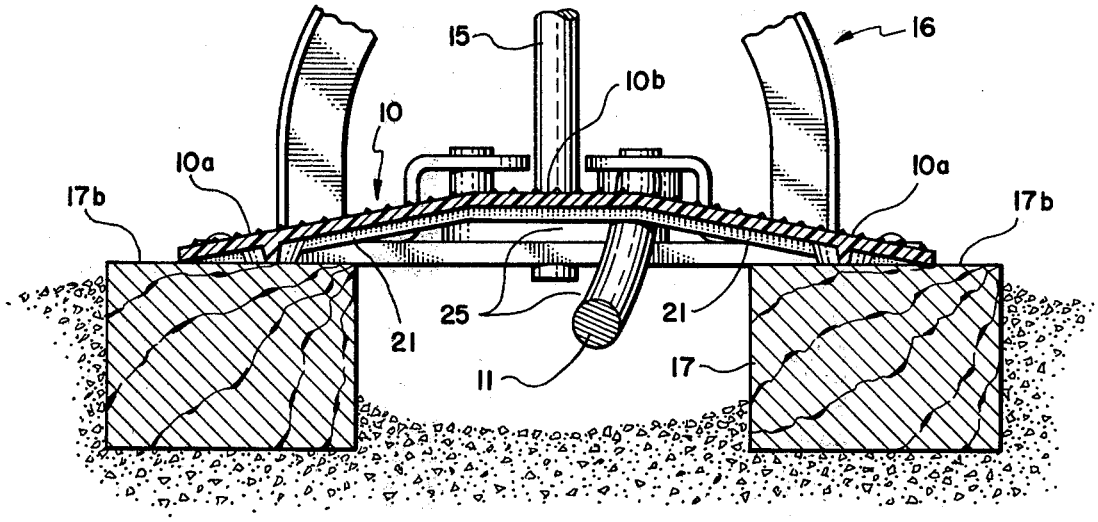
Figure 3:
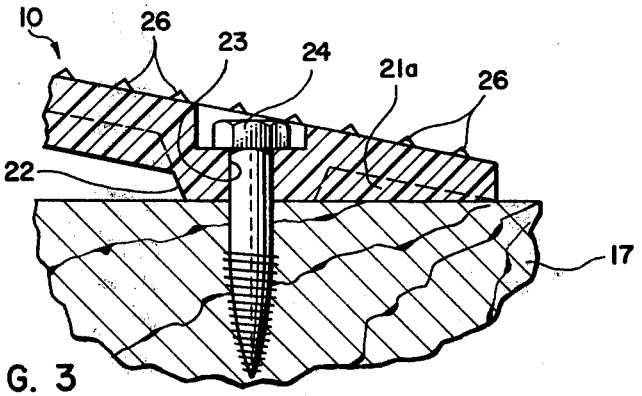
Figure 4:
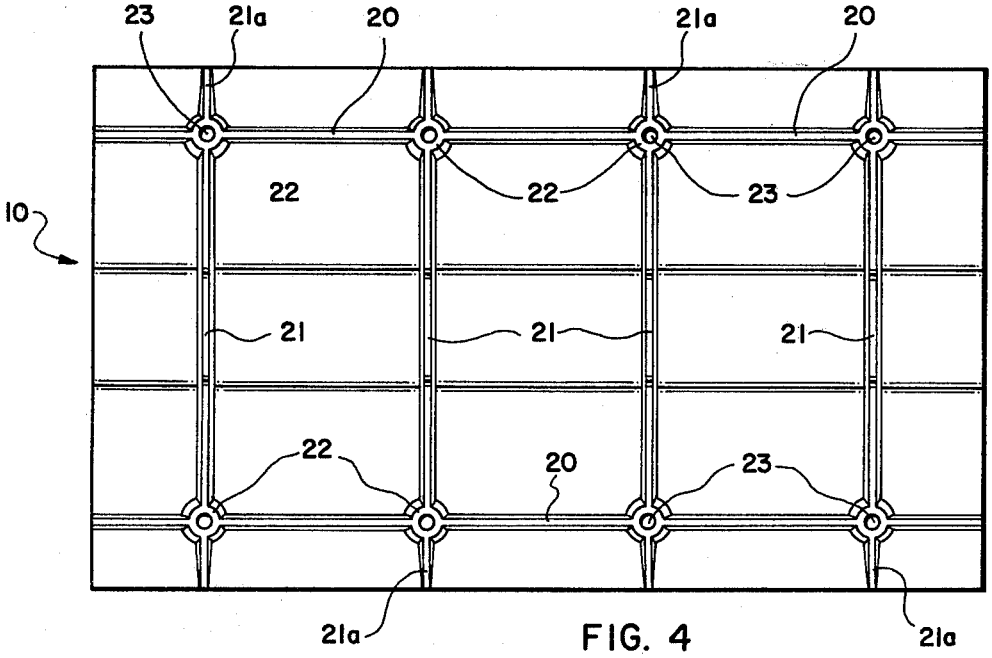

As installed and secured over connecting rod 11, safety cover 10 clears such connecting rod by ample space indicated at 25, FIG. 2, so as not to interfere with operation of the switching mechanism but to prevent any chance of a person tripping over the rod. The upper surface of such safety cover is advantageously provided with a non-slip or roughened tread 26 as by forming it during the molding operation.

It should be realized that the center section 10*b* of safety cover 10 need not be level as shown, but could be arcuate so as to merge smoothly with ramp sections 10*a*.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A railroad head block switching installation protected for the safety of foot traffic alongside a railroad track with which said installation is connected, comprising, in combination, switching rails mounted on railroad ties, two mutually adjacent ties of which are special and extend outwardly beyond the others at one side of the rails to accomodate switching apparatus made up of a rail switching bar disposed between said special ties, a switching stand mounted on said special ties remote from said rails and including mechanism for actuating said switching bar, and a connecting rod extending between said special ties and joining said mechanism with said bar for actuating the latter; a weight supporting safety cover for said connecting rod and the space between said special ties, said cover being molded to shape as an integral unit from a structural plastic material and being of elongate plate formation having opposing ramp sections of substantially equal extent and slope leading to a central section in common which overlies and is spaced above said connecting rod, said ramp sections covering the major portions of the widths of respective ones of said special ties, said safety cover being provided with reinforcing ribs on its underside, including longitudinal ribs extending along the longitudinal margins of said cover and transverse ribs extending at intervals transversely of the ramp sections and of the center section and intersecting the longitudinal ribs, there being bosses formed at the respective rib intersections, and the end portions of the transverse ribs tapering from the bosses to the level of the undersides of the longitudinal edges of the cover; and lag screws extending through said bosses and screwed into said special ties for securing the cover in place.

2. A railroad head block switching installation in accordance with claim 1, wherein the upper surface of the safety cover is provided with a roughened tread.

3. A railroad head block switching installation in accordance with claim 1, wherein the central section of the cover is substantially level.

4. A weight-supporting safety cover for the connecting rod of a railroad head block switching installation, comprising structural plastic material of elongate plate formation having opposing ramp sections of substantially equal extent and slope extending along and transversely of the length of the cover and leading to a central section in common adapted to overlie and be spaced above the connecting rod of a railroad head block switching installation, said ramp sections being adapted to cover the major portions of the widths of tie sidewise extensions of the railroad track of said installation between which the connecting rod extends, said safety cover being provided with reinforcing ribs on its underside, including longitudinal ribs extending along the longitudinal margins of said cover and transverse ribs extending at intervals transversely of the ramp sections and of the center section and intersecting the longitudinal ribs, there being bosses formed at the respective rib intersections and the end portions of the transverse ribs tapering from the bosses to the level of the undersides of the longitudinal edges of the cover.

5. A safety cover for a railroad head block switching installation in accordance with claim 4, wherein there are openings through the bosses, for accommodating respective lag screws to secure the cover to the tie sidewise extensions.

6. A safety cover for a railroad head block switching installation in accordance with claim 4, wherein the upper surface of the safety cover is provided with a roughened tread.

7. A safety cover for a railroad head block switching installation in accordance with claim 4, wherein the central section of the cover is substantially level.

* * * * *